US006460312B1

(12) United States Patent
Nakagawa et al.

(10) Patent No.: US 6,460,312 B1
(45) Date of Patent: Oct. 8, 2002

(54) PACKAGING SYSTEM WITH IMPROVED FLOW OF ARTICLES

(75) Inventors: Yukio Nakagawa; Katsuaki Kono, both of Shiga; Yasushi Yamaguchi, Kyoto, all of (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 09/545,281

(22) Filed: Apr. 7, 2000

(30) Foreign Application Priority Data

Apr. 7, 1999 (JP) ..... 11-099644

(51) Int. Cl.[7] ..... B65B 57/00; B65B 1/32

(52) U.S. Cl. ..... 53/55; 53/493; 53/548; 53/550; 53/502

(58) Field of Search ..... 53/52, 55, 58, 53/75, 493, 502, 503, 504, 545, 548, 550, 551, 552

(56) References Cited

U.S. PATENT DOCUMENTS

| | | | | | |
|---|---|---|---|---|---|
| 3,916,598 | A | * | 11/1975 | Adams et al. | 53/493 |
| 4,128,985 | A | * | 12/1978 | Simmons | 53/502 |
| 4,546,596 | A | * | 10/1985 | Cherney | 53/75 |
| 4,597,240 | A | * | 7/1986 | Scully | 53/552 |
| 4,813,205 | A | * | 3/1989 | Mikata et al. | 53/502 |
| 5,241,800 | A | * | 9/1993 | Steinke et al. | 53/55 |
| 5,533,322 | A | * | 7/1996 | Bacon et al. | 53/550 |
| 5,540,035 | A | * | 7/1996 | Plahm et al. | 53/550 |
| 5,822,949 | A | * | 10/1998 | Naoi | 53/55 |
| 5,924,268 | A | * | 7/1999 | Fukuda et al. | 53/550 |
| 6,233,902 | B1 | * | 5/2001 | Nakagawa | 53/502 |
| 6,285,918 | B1 | * | 9/2001 | Kono | 53/502 |

FOREIGN PATENT DOCUMENTS

| | | | |
|---|---|---|---|
| JP | 04-128105 | | 4/1992 |
| JP | 05-278729 | | 10/1993 |
| JP | 07-187153 | | 7/1995 |
| JP | 10-236408 | | 8/1998 |
| WO | WO 97/02179 | * | 1/1997 |

* cited by examiner

*Primary Examiner*—Stephen F. Gerrity
*Assistant Examiner*—Louis Huynh
(74) *Attorney, Agent, or Firm*—Hogan & Hartson, LLP

(57) ABSTRACT

A packaging system for causing articles M to fall downward along a predetermined falling route A and filling the articles M into a tubular film F. The packaging system is provided with an auxiliary device 205 operating on the falling route A at predetermined timing and facilitating or improving the flow of the articles M, determination unit 21*a* determining whether a state of the flow of the articles M on the falling route A is normal or abnormal, and a change unit 21*b* changing the operating timing of the auxiliary device 205 according to the state of the flow of the articles M determined by the determination unit 21*a*. With this configuration, the state of the flow of the articles M is improved and the high productivity (yield) and/or operativity of the packaging system can be maintained.

6 Claims, 9 Drawing Sheets

TIMING STORAGE 23a

| CALL NO. | PRODUCT NAME | END SEALER SET TIME(ms) (Tj) | POKER SET TIME(ms) (Ts) |
|---|---|---|---|
| 001 | POTATO CHIPS (SALT) | 100 | 10 |
| 002 | PATATO CHIPS (CURRY) | 100 | 10 |
| 003 | CANDY | 50 | 5 |
| : | : | : | : |

Fig.5B

PACKAGING SYSTEM WITH IMPROVED FLOW OF ARTICLES

BACKGROUND OF THE INVENTION

1. Field of the Invention

The present invention relates to a so-called vertical pillow type packaging system with an improved flow of articles to be packaged.

2. Description of the Prior Art

A conventional packaging system will be described with reference to FIG. 1 showing one embodiment of the present invention.

In FIG. 1, after articles M discharged from a combination weighing apparatus 1 fall downward intermittently to a chute 203, they are packaged continuously by a bagging and packaging machine 200. While the articles M falling from above are filled into a tubular film F, the bagging and packaging machine 200 fuses (seals) and then cuts an upper end F1 of a film F positioned above the articles M by means of sealing jaws 202*a* provided on a tip end of an end sealer (sealing means) 202, to thereby continuously package products M1.

In the afore-mentioned packaging system, if the articles M are bulky such as potato chips, then they may interfere with one another at a passage-tapered portion A1 of a funnel-like hopper 203, the flow of the articles M become slower or they sometimes form a bridge and completely clog.

To solve such clogging, an auxiliary device 205 referred to as "poker" is provided to force the articles M within a chute 203 to fall downward (see, for example, the Japanese Laid-Open Patent Publication No. 10-236408). Namely, the poker 205 is provided with a clapper H. The clapper H projects from an initial position indicated by a solid line into a position indicated by a double-dotted line, thereby forcing the articles M almost clogging within the chute 203 into the chute to cause them to fall downward.

In some cases, however, good operating timing at which the clapper H projects into the chute 203 is not taken and the clogging of the articles M cannot be completely removed. As a result, weight-defective products M1 are packaged and thus system productivity deteriorates. In addition, since the system operates at high speed, large amounts of articles M accumulate in a short period of time if the articles M begin clogging. It takes a lot of time and labor to remove the large amounts of accumulated articles M and restart the system, so that system operativity greatly decreases.

Meanwhile, if the articles M interfere with one another and the flow thereof becomes slower, the distance between a former group of articles M which are now falling and a later group of articles M becomes shorter and accordingly, the sealing means cannot operate at good timing. As a result, part of the later articles M are mixed into the former articles M or part of the former articles M are captured into the later articles M and packaged. As a result, weight-defective products M1 are produced and thus system productivity deteriorates.

It is, therefore, an object of the present invention to maintain the high productivity (production yield) and operativity of a packaging system by improving the operating timing of an auxiliary device and that of sealing means.

SUMMARY OF THE INVENTION

As mentioned above, the abnormal flow of articles is considered to be caused by the defective timing of an auxiliary device and that of seal means.

Taking this into consideration, a packaging system according to the one aspect of the present invention is intended to improve the defective timing of auxiliary device, and comprises an auxiliary device operating on the falling route at predetermined timing and facilitating or improving a flow of the articles; determination means for determining whether a state of the flow of the articles on the falling route is normal or abnormal; and change means for changing the predetermined timing of the auxiliary device according to the state of the flow of the articles determined by the determination means.

According to one aspect of the present invention, the predetermined operating timing of the auxiliary device is automatically changed, so that the state of flow is improved. It is thereby possible to suppress the occurrence of weight-defective products and to maintain the high productivity of the packaging system.

A packaging system according to another aspect of the present invention is intended to improve the defective timing of sealing means, and comprises sealing means operating on the falling route at predetermined timing, for sealing the end of the film in a direction vertical to a transfer direction of the film; determination means for determining whether a state of a flow of the articles on the falling route is normal or abnormal; and change means for changing the predetermined timing of the sealing means according to the state of the flow of the articles determined by the determination means.

According to another aspect of the present invention, the predetermined operating timing of the sealing means is automatically changed, so that the flow state of the articles is improved. It is thereby possible to suppress the occurrence of weight-defective products and to maintain the high productivity of the packaging system.

The term "articles" referred to hereinabove and hereinafter is intended to mean a group of matters weighed and bagged, and the term "product" referred to hereinabove and hereinafter is intended to mean the bagged group.

The term "falling route" referred to hereinabove and hereinafter is intended to mean the route of the articles in the packaging machine or upstream of packaging machine, which route is taken by the articles discharged from a weighing apparatus or the like until they are filled into a bag by a packaging machine.

The term "a state of the flow of articles" referred to hereinabove and hereinafter is intended to mean a state of the articles on the falling route and to encompass the clogging of the articles on the falling route.

As "determination means", may be used means for determining whether the state of the flow of the articles is normal or abnormal based on the weight of a product packaged, or on the weight difference between before packaging and after packaging.

"Change means" preferably feedback-controls the operating timing of an auxiliary device and/or that of the sealing means while using a signal from the determination means as an input.

The term "feedback control" means detecting a control result, determining whether or not the result is appropriate, transmitting an appropriate correction signal and controlling a target as originally commanded. This control can be carried out based on, for example, surplus or shortage of the weight of a packaged product, the frequency of surplus or shortage thereof and/or the surplus or shortage amount thereof.

Further, according to the present invention, if there is provided a timing storage for updating and storing the operating timing of the auxiliary device or that of the sealing means according to the type of the articles or products, it is possible to minutely change the operating timing according to the type of the articles or products and to thereby maintain the high productivity of the packaging system.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

FIG. 5B is a diagram showing the stored contents of a timing storage;

DETAILED DESCRIPTION OF THE EMBODIMENTS

One embodiment according to the present invention will be described hereinafter with reference to FIGS. 1 to 7.

First, a bagging, filling and packaging system according to the present invention will be outlined.

Figure 1:
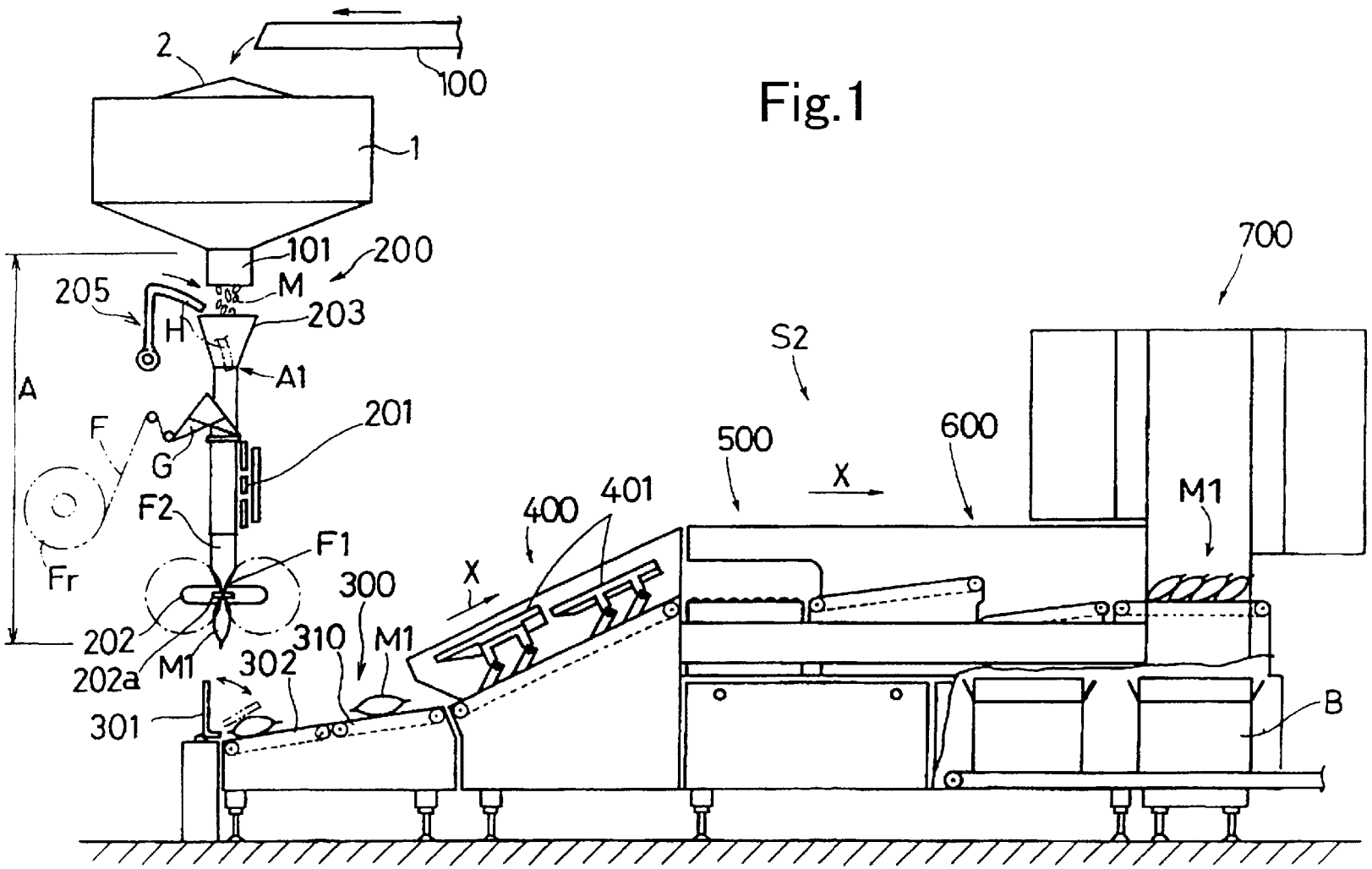
FIG. 1 is a schematic side view of a packaging system in one embodiment according to the present invention.

In FIG. 1, reference numeral 100 represents a delivery conveyer, reference numeral 1 represents a combination weighing apparatus, reference numeral 200 represents a bagging and packaging machine (a packaging machine), reference numeral 300 represents a weight checker (weighing conveyer), reference numeral 400 represents a seal checker, and reference numeral 700 represents a boxing machine.

The delivery conveyer 100 causes articles M to fall onto the central portion of a dispensing feeder 2 of the combination weighing apparatus 1. The combination weighing apparatus 1 combines some of the weights of the articles M supplied into a number of weighing hoppers (not shown), combines the articles M, whereby the total weight of the articles M thus combined can attain a combination calculated value Wc equal or approximate to a target weight to allow the articles M to fall into the bagging and packaging machine 200 disposed downward.

The bagging and packaging machine 200 is a so-called vertical pillow type bagging machine. In the machine 200, a vertical sealer 201 fuses a sheet-like web of film F drawn from a film roll Fr and forms the film F into a tubular shape. While the articles M falling downward from above are being filled into the tubular film F, sealing jaws 202*a* provided on tip end of an end sealer (sealing means) 202 fuse (seal) and then cut an upper end (film end) F1 of the film F above the articles M to thereby continuously package products M1 in a certain cycle time (see, for example, the Japanese Laid-Open Patent Publication No. 4-128105).

A packaged product M1 falls downward, is laid onto a receiving conveyer 302 by a knock-down member 301 and transported by the conveyer 302 onto the weight checker 300. The weight checker 300 weighs and inspects the product M1 while the product M1 is being transported diagonally upward. The product M1 is transported from the weight checker 300 toward the seal checker 400.

The seal checker 400 transports the product M1 transferred from the weight checker 300 while the product M1 is suppressed from above by a retainer member 401 and, during transport, inspects the presence or absence of a defective seal in a bag of the product M1 and the length of the product M1. A sorting device 500 ejects the product M1 out of the system if the product M1 received from the seal checker 400 is deemed defective and transports the product M1 downstream if it is deemed acceptable based on the inspection result. The product M1 is transported toward the downward boxing machine 700 through a transport apparatus consisting of the sorting device 500, a line-up transport device 600 and the like. The boxing machine 700 loads products M1 into a cardboard box B.

Next, the detail of the bagging and packaging machine 200 will be described.

Figure 2:
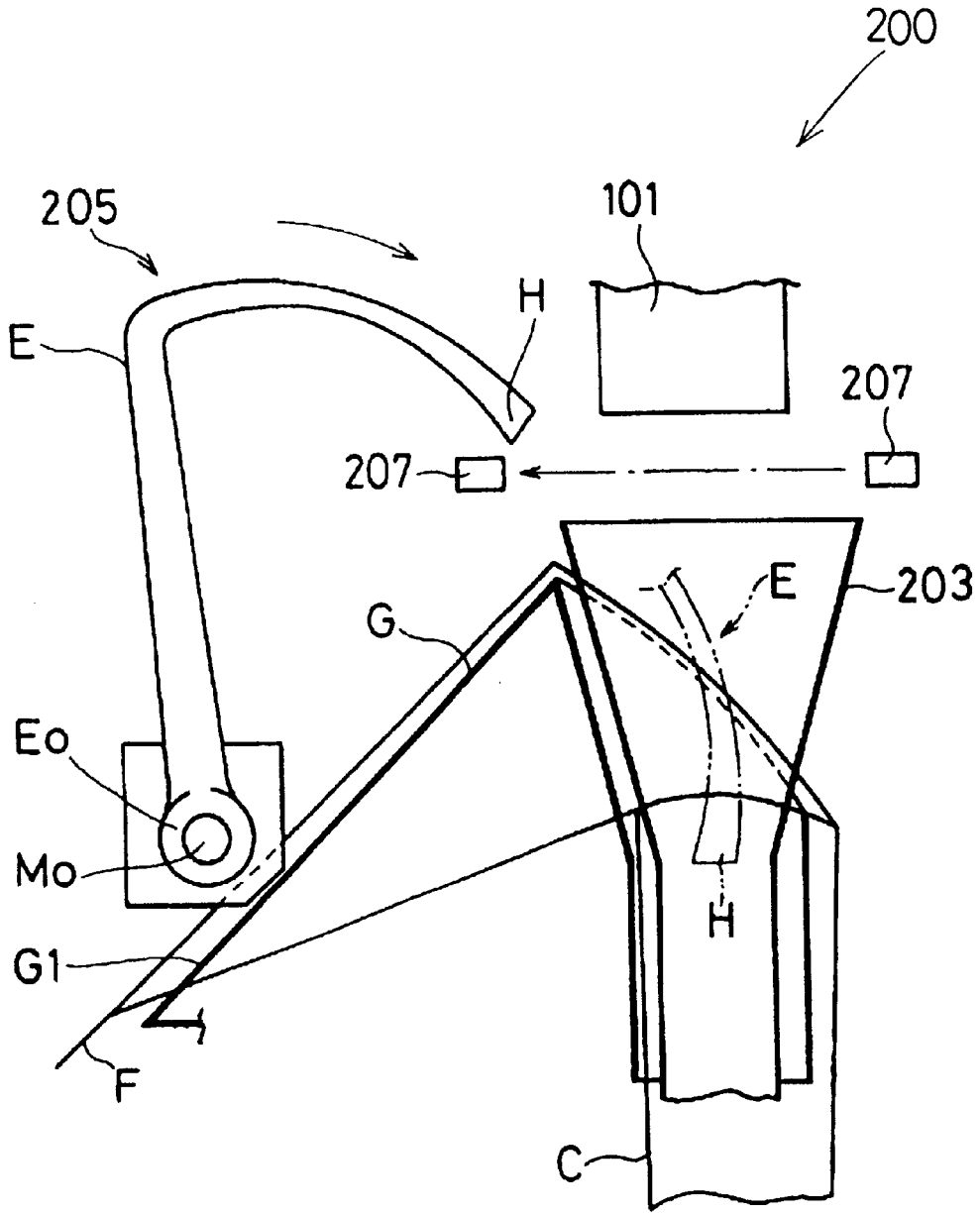
FIG. 2 is a cross-sectional view of a poker.

As shown in FIG. 2, the bagging and packaging machine 200 comprises a former G having a film guide G1. In the bagging and packaging machine 200, while the sheet-like film F drawn from the film roll Fr (FIG. 1) is being guided by the guide G1, the former G folds the film F so as to overlap both sides of the film F to form a tubular body C. Thereafter, in the bagging and packaging machine 200, the vertical sealer 201 shown in FIG. 1 fuses the overlapped both sides of the tubular body C and the sealing jaws 202*a* fuse and cut the tubular body C in width direction, thereby forming a bag F2 having a sealed lower end portion.

A discharge chute 101 of a combination weighing apparatus 1 is disposed above the former G (FIG. 2). The articles M discharged from the discharge chute 101 fall downward into the bag F2 having the sealed lower end portion, the end portion F1 above the bag F2 is fused and cut by the sealing jaws 202*a* and the products M1 are continuously packaged in a predetermined cycle time.

A poker (an auxiliary device) 205 is provided at the bagging and packaging machine 200 to facilitate or improve the flow of the articles M. As shown in FIG. 2, the poker 205 has an L-shaped arm E. A clapper H is provided on the tip end of the arm E. A base Eo of the arm E is connected to an output shaft Mo of a motor through a reduction gear unit (which is not shown). By the rotation of the motor, the arm E moves angularly from an initial position indicated by a solid line to an operating position indicated by a double-dotted line, whereby the clapper H projects into an introduction chute 203 and claps the articles M within the introduction chute 203 to cause the articles M to fall downward, facilitating or improving the flow of the articles M (see, for example, the Japanese Laid-Open Patent Publication No. 10-236408).

Figure 3A:
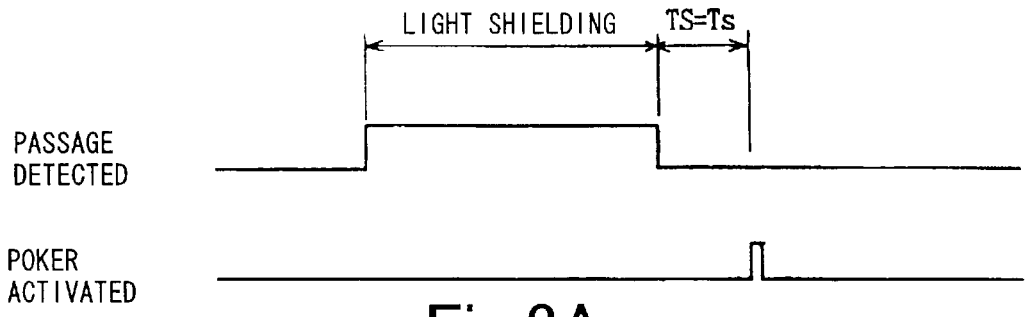
FIGS. 3A to 3C are timing charts showing the operating timings of the poker.

As shown in FIG. 2, a passage detector 207 is disposed between the introduction chute 203 and the discharge chute 101. The passage detector 207 comprises, for example, an area sensor having a line-type photo-detector for detecting the articles M. As shown in FIG. 3A, after the passage detector 207 has detected the articles M, the poker 205 is activated after the passage of a predetermined poker set time Ts to be described later from the time the detector 207 has no longer detected the articles M.

Figure 4:
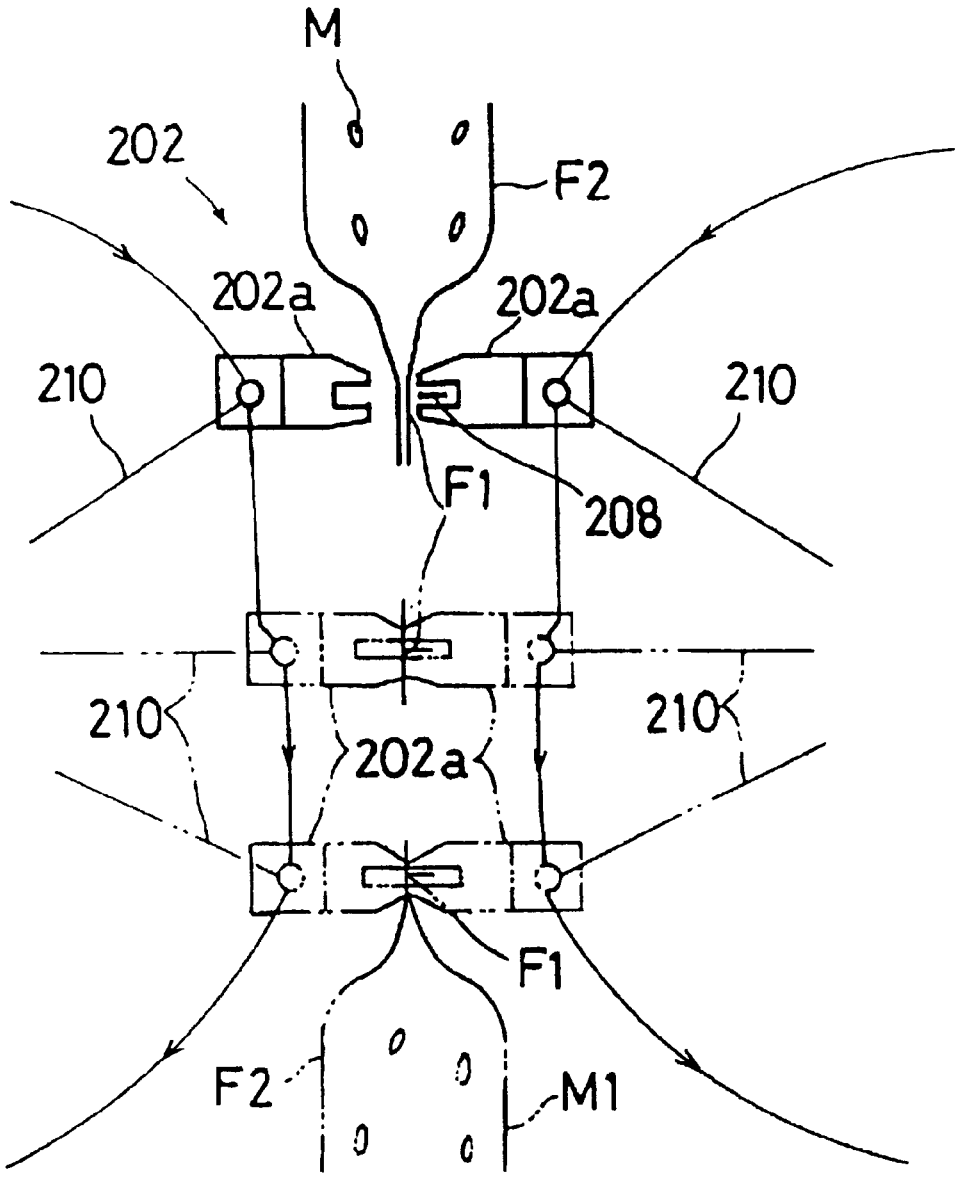
FIG. 4 is a cross-sectional view of an end sealer.

As shown in FIG. 4, the end sealer 202 has a pair of arms 210 and sealing jaws 202*a* provided on the tip ends of the arms 210, respectively. The sealing jaws 202*a* clamp the bag F2 between them from lateral direction, thermally seal and cut the bag F2. The base of each arm 210 is connected to a servo motor which is not shown in FIG. 4. The right and left sealing jaws 202*a* carry out packaging operation in a manner in which they rotate in directions opposite each other as indicated by arrows, pass the positions indicated by solid lines, go downward toward the positions indicated by double-dotted lines while clamping the bag F2 therebetween, seal the upper end F1 of the preceding bag F2 (the lower end F1 of the following bag F2) and cut the bag F2 with cutter 208 (see, for example, the Japanese Laid-Open Patent Publication No. 5-278729).

Next, description will be given to the principle of a manner in which the operating timing of the end sealer 202 (which timing will be referred to as "sealing timing" hereinafter) and the timing of the poker 205 (which timing will be referred to as "ramming timing" hereinafter) are changed in this embodiment.

If the weight defects of the products M1 are repeated a predetermined number of times, there is a possibility that the sealing timing has deviated. In other words, it is suspected that before the last articles M of the preceding group of the articles M arrive at a predetermined level, the sealing operation is carried out and such last articles M mix into the next bag, with the result that the shortage or surplus of the weight of the product M1 may possibly occur repeatedly. Accordingly, the system is operated while delaying the sealing time by a predetermined time. It is then determined whether or not weight defects occur repeatedly during a predetermined number of subsequent weighing operations, and control for further delaying the sealing timing until the weight defects are removed is repeatedly carried out (feedback-control is carried out). Consequently, it is possible to eliminate the weight defects of the products M1.

In the meantime, if weight defects occur repeatedly, there is a likelihood that, other than the deviation of sealing timing as mentioned above, the ramming timing has deviated. Accordingly, in a case where the weight defects cannot be removed even if the sealing timing is changed a predetermined number of times by the afore-mentioned method, the ramming timing is changed. That is, the system is operated while changing the ramming timing, and it is determined whether or not weight defects occur repeatedly during a predetermined number of subsequent weighing operations. Then, the ramming timing is changed repeatedly (feedback-control is carried out) until the weight defects do not occur any longer. Consequently, it is possible to eliminate the weight defects of the products M1.

Next, one example of controlling to carry out the afore-mentioned control will be described.

Figure 5A:
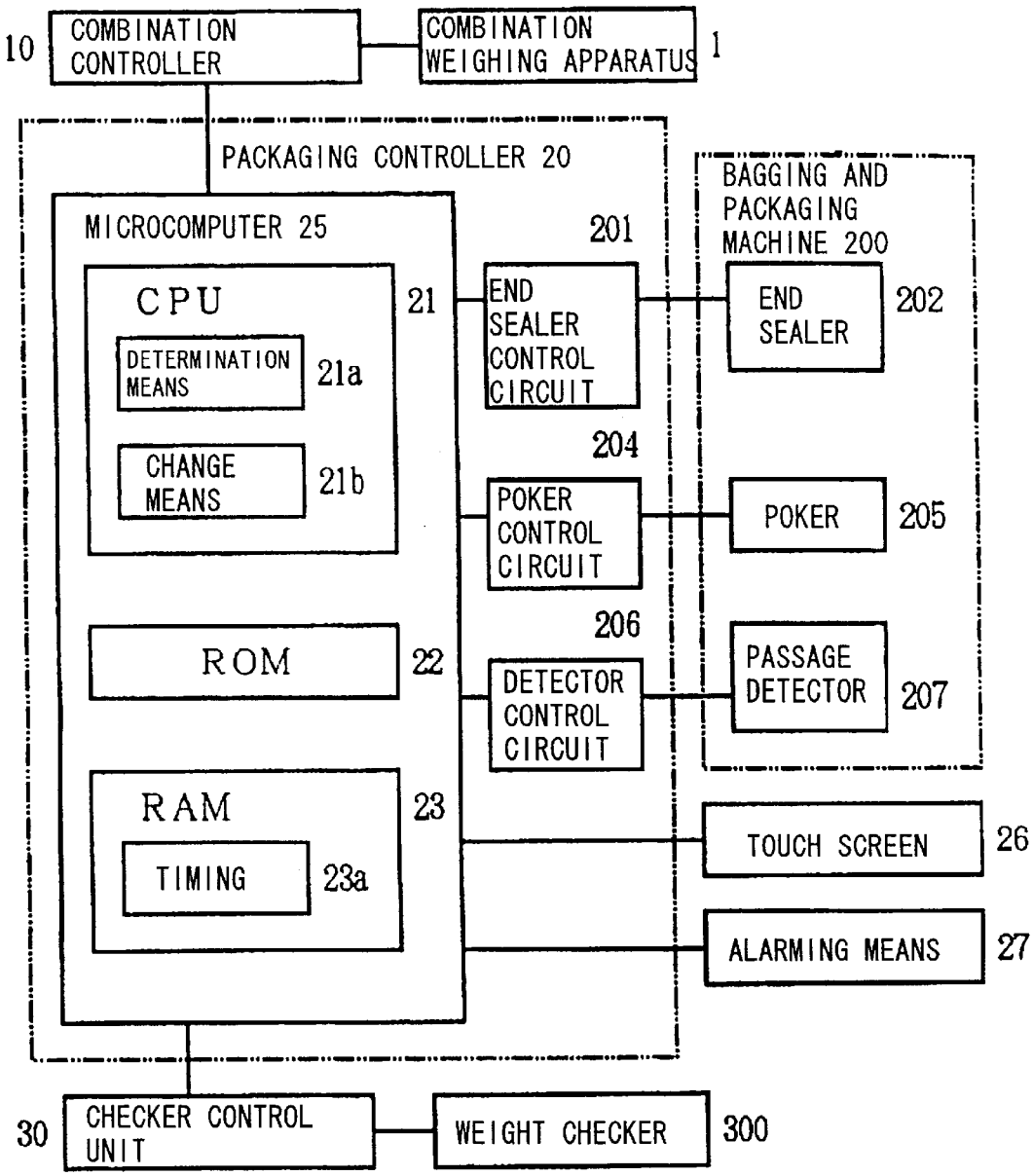
FIG. 5A is a schematic block diagram showing the important portion of the system.

As show in FIG. 5A, a packaging controller 20 is connected to not only a combination controller 10 and a checker control unit 30 but also machine parts such as an actuator and a motor. The combination controller 10 and the packaging controller 20 are coupled to each other by an interlocking signal T, to allow a weighing apparatus side for discharging the articles and the packaging apparatus side for receiving the articles to operate in an associated manner.

Interfaces, which are not shown, are inserted between the respective control equipment and the like.

The combination controller 10 controls the combination weighing apparatus 1 and transmits the afore-mentioned combination calculated value Wc to the packaging controller 20 every time the combination weighing apparatus 1 performs a combination weighing operation. The checker control unit 30 controls the weight checker 300 and transmits a post-discharge measured value Ws obtained by subtracting a tare weight from the gross weight of the product M1 to the packaging controller 20.

The packaging controller 20 has a microcomputer 25, an end sealer control circuit 201, a poker control circuit 204 and a detector control circuit 206. The detector control circuit 206 is connected to the passage detector 207. The detector control circuit 206 outputs a detection signal to the microcomputer 25 from the time it detects the articles M (shields light) until the detector 207 does not detects the articles M any longer (transmits light). The poker 205 and the end sealer 202 are connected to the poker control circuit 204 and the end sealer control circuit 201, respectively.

The microcomputer 25 has a central processing unit (CPU) 21, a read-only memory (ROM) 22 and a random access memory (RAM) 23. The packaging controller 20 makes the end sealer 202 wait at a predetermined origin and outputs a discharge request signal to the combination controller 10. When receiving the discharge request signal, the combination controller 10 effect combination weighing apparatus 1 to discharge the articles M combination-weighed by the combination weighing apparatus 1. The combination controller 10 outputs the combination measured value Wc and a discharge completion signal to the packaging controller 20.

When the articles M are discharged from the discharge chute 101 (FIG. 1), the CPU 21 as shown in FIG. 3A, starts counting poker delay time TS after the passage detector 207 detects the shielding due to the articles M and detects light transmission again, i.e., the CPU 21 does not receive the detection signal any longer after receiving the detection signal from the detector control circuit 206. The CPU 21 activates the poker 205 when the poker delay time TS passes.

Meanwhile, the CPU 21 calculates delay time TJ from the time the discharge request signal is outputted to the combination controller 10 or from the time the discharge completion signal is received therefrom until the right and left sealing jaws 202*a* and 202*a* are engaged with each other, and outputs the resultant delay time TJ to the end sealer control circuit 201. The end sealer control circuit 201 controls the speed of angle of rotation based on the delay time TJ. As a result, at the delay time TJ later, the right and left sealing jaws 202*a* and 202*a* arrive at a position at which they are engaged with each other.

The CPU 21 has the first, second and third counters K, L and N not shown as well as determination means 21*a* and change means 21*b*. The determination means 21*a* determines whether or not the weight of the product M1 measured by the weight checker 300 (FIG. 1) is defective. For example, if the post-discharge measured value Ws of the product M1 is not less than an upper limit value or not more than a lower limit value (if the value Ws does not satisfy the relationship of ((lower limit value)<(post-discharge measured value Ws)<(upper limit value)), then the determination means 21*a* determines that the weight of the product M1 is defective. The change means 21*b* changes the sealing timing and/or the ramming timing according to the detected flow state of the articles M.

The RAM 23 has a timing storage 23*a*.

The timing storage 23*a* as shown in FIG. 5B, stores end sealer set time Tj and poker set time Ts in association with Call No. and a product name. The end sealer set time Tj and the poker set time Ts are preset for each product M1, updated by the CPU 21 and stored in the storage 23*a*.

A touch screen 26 and alarming means 27 are connected to the microcomputer 25. The touch screen 26 is provided with, for example, a liquid crystal display unit, which unit makes displays in various manners according to the outputs of the CPU 21. The alarming means 27 buzzes (alarms) in response to a signal from the CPU 21 and puts on an alarming light (alarms).

Figure 6:
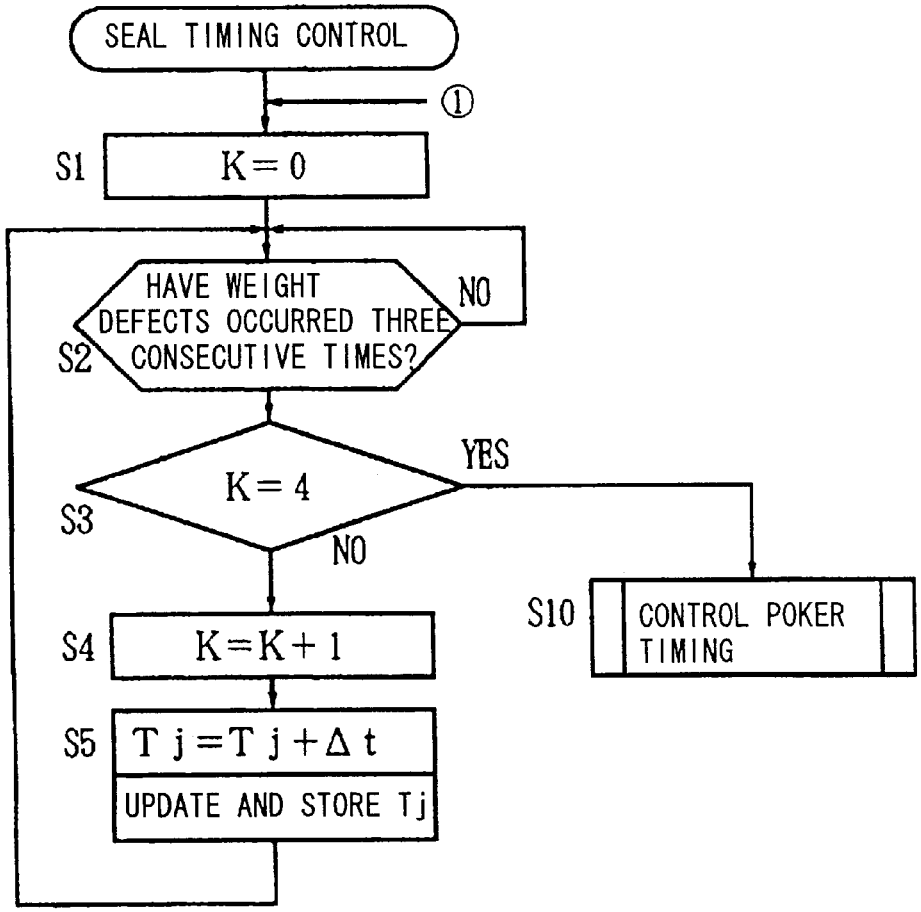
FIG. 6 is a flow chart showing the operation of the system.
Figure 7:
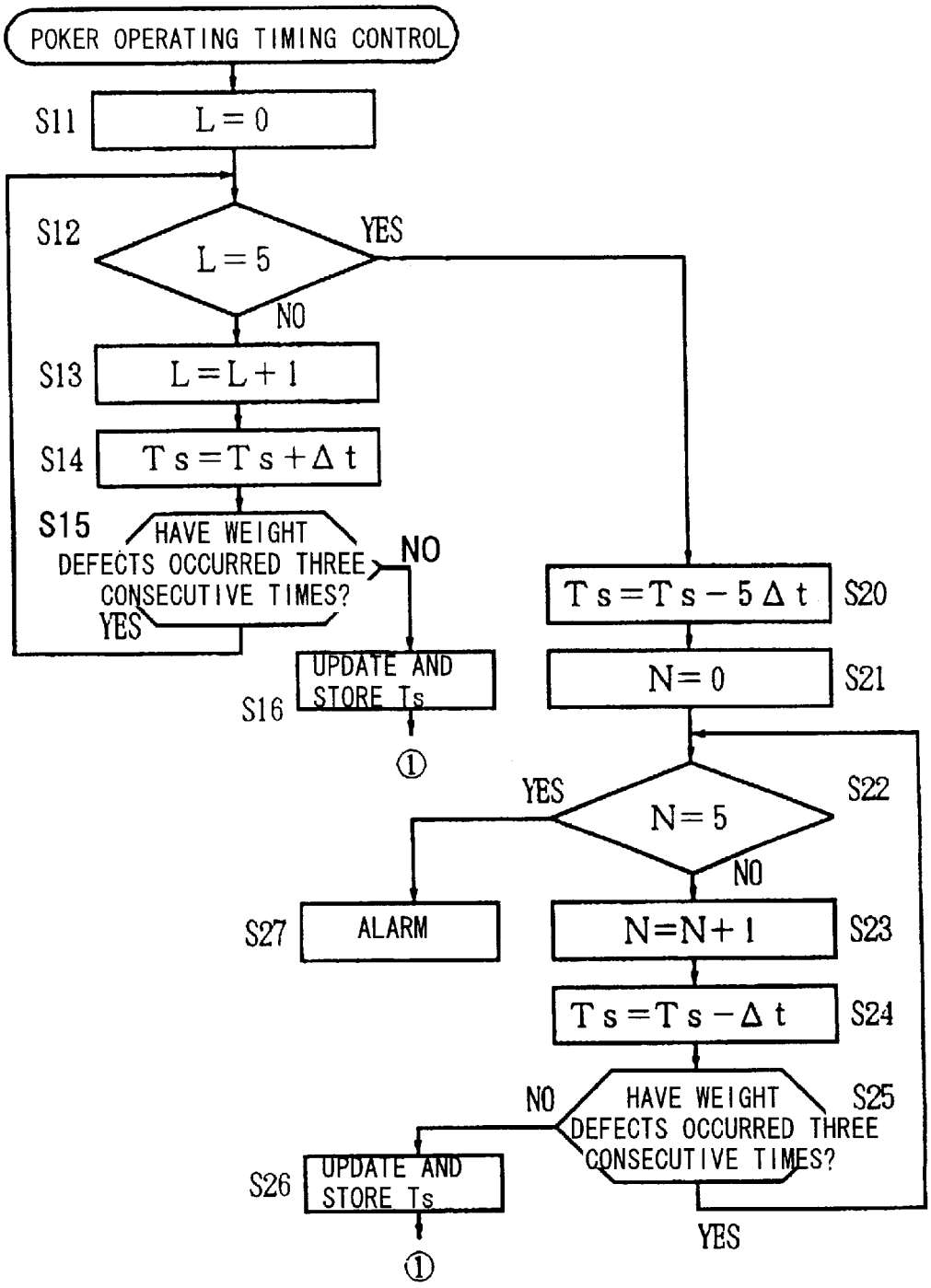
FIG. 7 is a flow chart showing the operation of the system.

Next, the operation of the packaging system in this embodiment will be described with reference to the flow charts of FIGS. 6 and 7.

When an operator selects a Call No. corresponding to a product M1 to be packaged, the CPU 21 reads end sealer set time Tj and poker set time Ts corresponding to the selected Call No. from the timing storage 23*a*. The CPU 21 loads the set time Tj and Ts thus read as end sealer delay time TJ and poker delay time TS, respectively, whereby the system starts.

In a step S1, the microcomputer 25 clears the first counter K to zero, followed by a step S2. In the step S2, the determination means 21*a* determines whether or not the weight of the product M1 measured by the weight checker 300 (FIG. 1) is defective. If the determination result indicates that weight defects occur three consecutive times, a step S3 follows. In the step S3, it is determined whether or not the first counter K reaches predetermined number (e.g., four). If the first counter K does not reach the number, a step S4 follows. In the step S4, the first counter K is incremented, followed by a step S5.

In the step S5, the change means 21*b* adds predetermined adjustment time Δt to the end sealer set time Tj, and stores the updated end sealer set time Tj (Tj=Tj+Δt) in the timing storage 23*a*. The CPU 21. defines the end sealer set time Tj as the delay time TJ and operates the system. The processing then returns to the step S2.

As can be seen from the above, if the weight defects occur a predetermined consecutive times, the sealing timing is automatically delayed by predetermined time. As a result, even if the articles M fall downward one after another, good sealing timing is ensured, thereby making it difficult for weight-defective products M1 to occur. Thus, it is possible to maintain high system productivity.

Figure 3B:
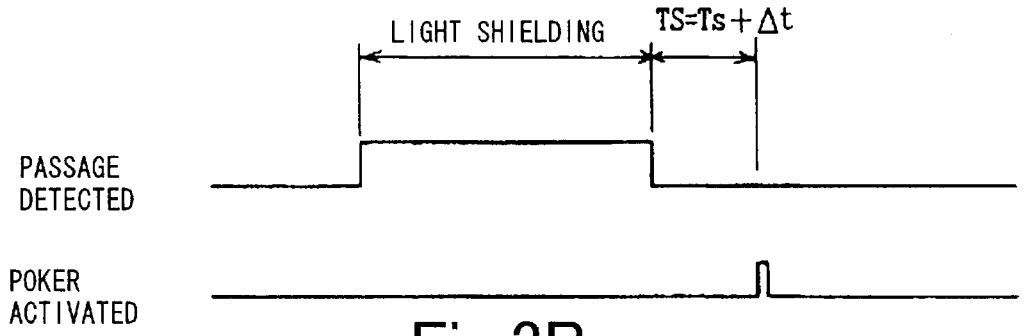

In the meantime, in the step S3, if the first counter K reaches the predetermined number, it is estimated that not the sealing timing but the poker operating timing causes the occurrence of weight defects and a step S10 follows. In the step S10, the poker operating timing is controlled as described below. The step S10 is followed by a step S11 shown in FIG. 7. In the step S11, the second counter L is cleared to zero and a step S12 follows. In the step S12, it is determined whether or not the second counter L reaches a predetermined number (e.g., five). If the second counter L does not reach the predetermined number, a step S13 follows. In the step S13, the second counter L is incremented, followed by a step S14. In the step S14, the change means 21*b* adds the predetermined adjustment time Δt to the poker set time Ts. As shown in FIG. 3B, the change means 21*b* defines the resultant poker set time Ts (Ts=Ts+Δt) as the poker delay time TS. The start timing of the poker 205 is controlled based on the poker delay time TS, followed by a step S15 shown in FIG. 7.

In the step S15, the determination means 21*a* determines whether or not there is a weight defect. If determination result indicates that weight defects occur three consecutive times, the step S12 is executed again. In the step S15, if it is determined that the weight defect does not occur consecutively or there is no weight defect, a step S16 follows. In the step S16, the change means 21*b* stores the updated poker set time Ts (Ts=Ts+nΔt) in the timing storage 23*a* and the step S1 (FIG. 6) is executed again.

In the S12, if the second counter L reaches the predetermined number (five), i.e., the weight defects are not removed even by delaying the ramming timing by predetermined time (5×adjustment time Δt), then the delayed predetermined time 5Δt is subtracted from the poker set time Ts (Ts=Ts×5Δt) to return the poker set time Ts to the original value and a step S21 follows. In the step S21, the third counter N is cleared to zero, followed by a step S22.

Figure 3C:
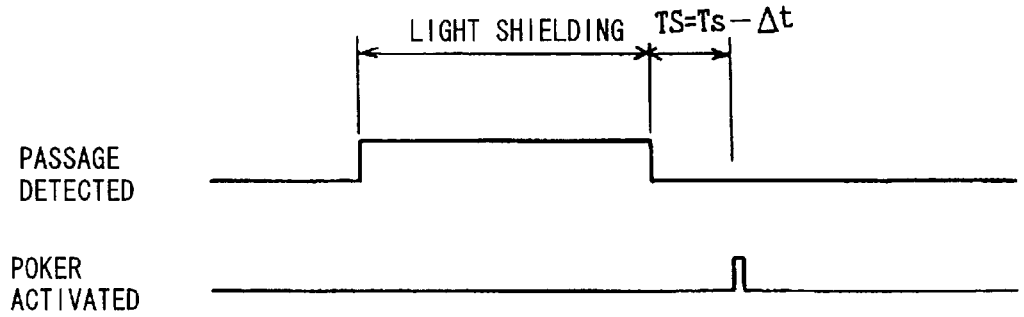

In the step S22, it is determined whether the third counter N reaches a predetermined number (e.g., five). If the third counter N does not reach the predetermined number, a step S23 follows. In the step S23, the third counter N is incremented, followed by a step S24. In the step S24, the change means 21*b* subtracts the predetermined adjustment time Δt from the poker set time Ts. As shown in FIG. 3C, the change means 21*b* defines the resultant poker set time Ts (Ts=Ts−Δt) as the poker delay time TS, and the start timing of the poker 205 is controlled based on the poker delay time TS, followed by a step S25.

In the step S25, the determination means 21*a* determines whether or not there is a weight defect. If determination result indicates that weight defects occur three consecutive times, the step S22 is executed again. If the determination result indicates that weight defects do not occur consecutively or no weight defect occurs, a step S26 follows. In the step S26, the change means 21*b* stores the updated poker set time Ts in the timing storage 23*a*. The step S1 (FIG. 6) is then executed again.

In the step S22, if the third counter N reaches the predetermined number, a step S27 follows. In the step S27, it is determined that the abnormal flow of the articles M cannot be improved by adjusting the sealing timing or ramming timing and an alarm message such as "Weight defects occur consecutively. Is there any abnormality in the system?" is displayed on the touch screen 26.

In this way, if the weight defects occur consecutively even by delaying the sealing timing, the poker ramming timing is automatically changed. Consequently, the state of flow of the articles M is improved, making it difficult for weight-defective products M1 to occur.

In the aforementioned embodiment, the determination means 21*a* determines the deviation of the sealing timing based on the determination as to whether or not the weight of the articles M is defective. The determination is not necessarily carried out based on the weight of the articles M. For example, if the sealing timing has deviated, the articles M are bit into the sealed portion of the bag F2 (FIG. 4). To avoid this, another arrangement may be made in that a bite detecting means is provided at the end sealer (see, for example, the Japanese Laid-Open Patent Publication No. 7-187153) and, when the detecting means detects bite, the sealing timing is automatically changed.

Furthermore, in the afore-mentioned embodiment, the determination means 21*a* determines a state of flow based on whether or not weight defects occur a predetermined consecutive times. It is also possible to determine a state of flow based on, for example, the frequency with which weight defects occur in a predetermined number of production cycles. In the latter case, the rate of improving the changed frequency may be fed back, thereby changing the value of the adjustment time Δt according to the improvement rate and conducting feedback-control.

Moreover, in the afore-mentioned embodiment, if the weight defects cannot be improved even by adjusting the sealing timing, the poker ramming timing is adjusted. If the ramming timing has deviated, there occurs a great shortage in the articles M. Considering this, either the adjustment of the sealing timing or that of the ramming timing may be selected depending on the degree of the shortage of weight.

Furthermore, only one of the sealing timing and the ramming timing may be adjusted.

Figure 8:
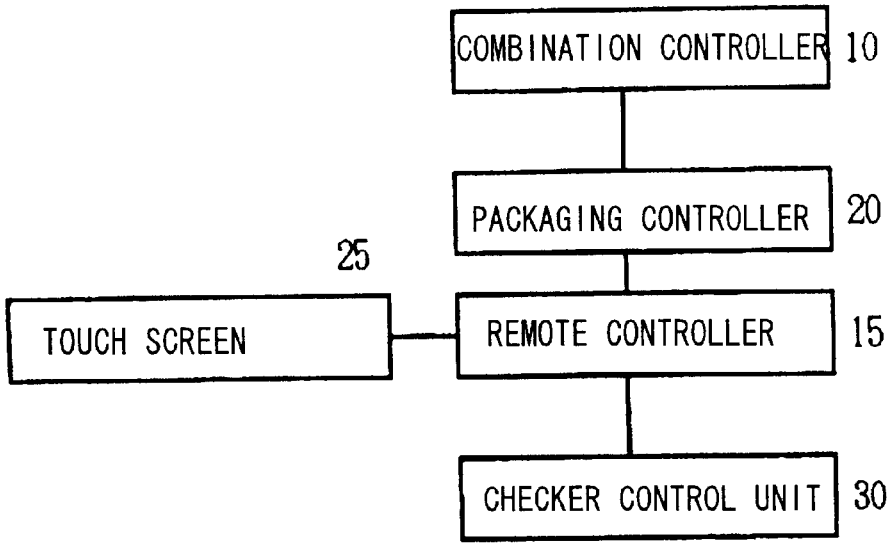
FIG. 8 is a schematic block diagram showing an example of a modification.

In addition, the functions of the CPU 21 may be distributed to a plurality of CPU. As shown in FIG. 8, for example, a remote controller 15 having the function of the determination means and that of the change means mentioned in the above embodiment, may be provided and connected to the combination controller 10 and the checker control unit 30.

Besides, the above embodiment has been described while using the end sealer 202 having the constantly rotating sealing jaws 202*a*. The present invention is also applicable to an end sealer having sealing jaws which undergo a reciprocating motion in horizontal direction (see, for example, the Japanese Laid-Open Patent Publication No. 7-187153) or the like.

The preferred embodiment has been described so far with reference to the drawings. However, those skilled in the art will readily conceive various changes and modifications within the framework of obviousness upon the reading of the specification herein presented of the present invention. Accordingly, such changes and modifications are, unless they depart from the scope of the present invention as defined by the claims annexed hereto, to be construed as included therein.

What is claimed is:

1. A packaging system for causing articles to fall downward along a predetermined falling route and filling said articles into a tubular film thereby producing packaged products, comprising:

an auxiliary device operating on said falling route after an interval from a time when the articles fall down, thereby facilitating or improving a flow of the articles;

a weight checker for weighing the packaged product; and a controller having:

determination means for determining whether a state of the flow of the articles on said falling route is normal or abnormal, based on a weight of the packaged product measured by the weight checker; and change means for changing the interval according to the state of the flow of the articles determined by said determination means, wherein a system feedback controls the change means based on the state of the flow determined by said determination means.

2. A packaging system according to claim 1, wherein said determination means determines whether the weight of the product is within a predetermined value range or not, and further determines whether the state of the flow of said articles is normal or abnormal, based on a result produced by the weight checker.

3. A packaging system according to claim 1, wherein the controller further comprises:

a timing storage for storing the interval according to a type of said articles, the interval may be updated.

4. A packaging system for causing articles to fall downward along a predetermined falling route and filling said articles into a tubular film thereby producing packaged products, comprising:

sealing means operating on said falling route after an interval from a time when the articles fall down, for sealing an end of said film in a direction orthogonal to a transfer direction of said film, a weight checker for weighing the packaged product; and a controller comprising:

determination means for determining whether a state of a flow of the articles on said falling route is normal or abnormal, based on a weight of the packaged product measured by the weight checker; and change means for changing the interval according to the state of the flow of the articles determined by said determination means, wherein a system feedback controls the change means based on the state of the flow determined by said determination means.

5. A packaging system according to claim 2, wherein said determination means determines whether the weight of the product is within a predetermined value range or not, and further determines whether the state of the flow of said articles is normal or abnormal, based on a result produced by the weight checker.

6. A packaging system according to claim 2, wherein the controller further comprises:

a timing storage for storing the interval according to a type of said articles, the interval may be updated.

* * * * *